United States Patent [19]

Mullich

[11] 3,990,277

[45] Nov. 9, 1976

[54] LOCK MECHANISM WITH DISENGAGEABLE KNOB

[75] Inventor: Richard O. Mullich, Burbank, Calif.

[73] Assignee: TRE Corporation, Beverly Hills, Calif.

[22] Filed: Apr. 6, 1976

[21] Appl. No.: 674,227

[52] U.S. Cl. ..... 70/107; 70/149; 70/462; 292/34

[51] Int. Cl.[2] ..... E05B 63/14

[58] Field of Search ..... 70/107, 111, 118, DIG. 63, 70/462; 292/34, 36, 47, 48, 139, 196, 244, 245, 138, 195, 184, 231, DIG. 25, DIG. 34, DIG. 35

[56] References Cited

UNITED STATES PATENTS

| | | | |
|---|---|---|---|
| 1,513,904 | 11/1924 | Hill | 70/149 |
| 3,101,604 | 8/1963 | North et al. | 70/107 |
| 3,390,558 | 7/1968 | Tornoe et al. | 70/107 |
| 3,791,180 | 2/1974 | Doyle | 70/107 |
| 3,910,613 | 10/1975 | Nolin | 70/107 X |
| 3,933,016 | 1/1976 | Nolin | 70/149 |

*Primary Examiner*—J. Franklin Foss

*Attorney, Agent, or Firm*—Blakely, Sokoloff, Taylor & Zafman

[57] ABSTRACT

A lock mechanism with disengageable knob whereby the locking of the mechanism decouples the exterior knob from the latch mechanism to allow the free rotation thereof without damage or detriment to the mechanism. The exterior knob is coupled to a cam member which actuates a spring loaded slide plate, which in turn may pick up a lock mechanism actuating member dependent upon whether the interior lock actuator is in the locked or unlocked position.

16 Claims, 7 Drawing Figures

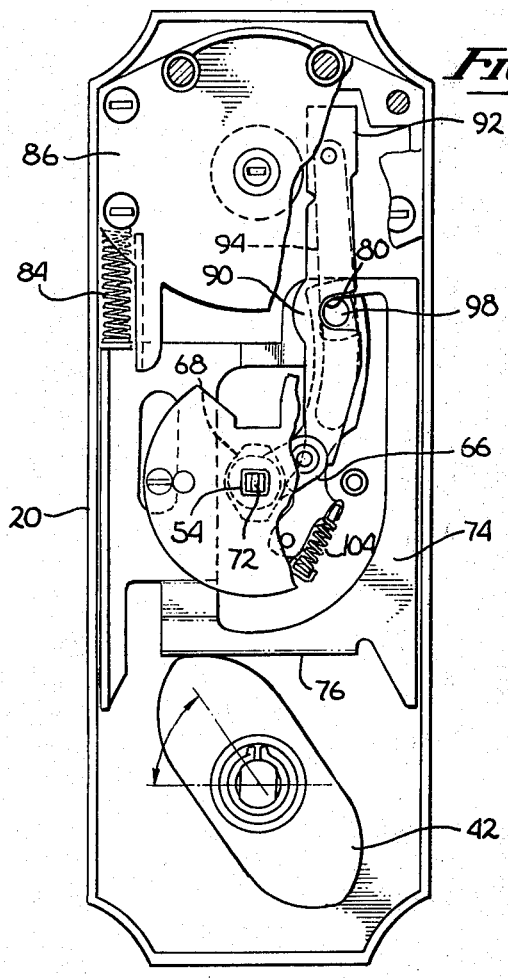
Fig. 4
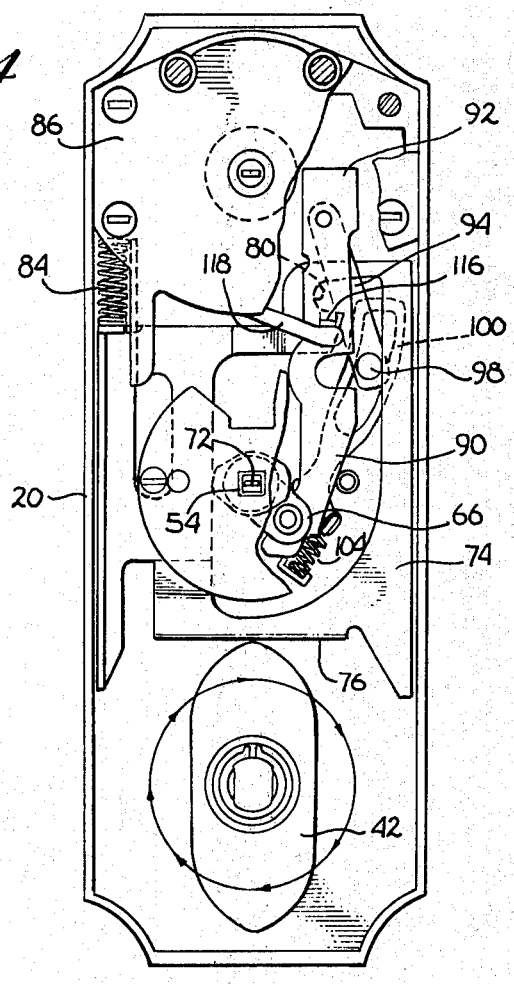
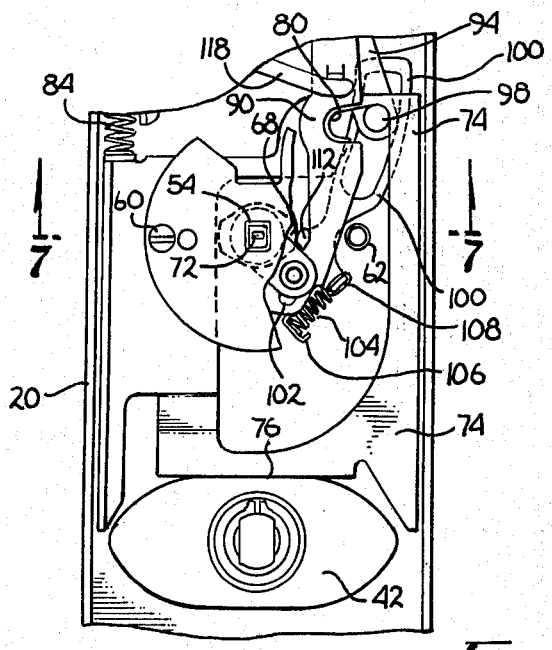
Fig. 5
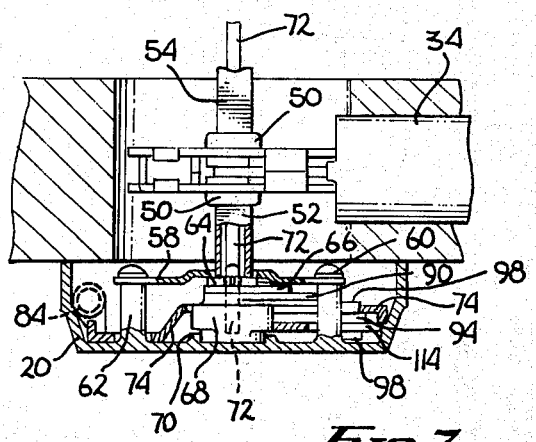
Fig. 6
Fig. 7

LOCK MECHANISM WITH DISENGAGEABLE KNOB

BACKGROUND OF THE INVENTION

1. Field of the Invention

The present invention relates to the field of door latch and lock mechanisms.

2. Prior Art

External door locks are common targets of abuse and vandalism. In particular, latch mechanisms sometimes partially jam due to such reasons as the misalignment between the latch bolt and the striker plate, and warped or partially obstructed doors. Accordingly, in common useage the determination of whether or not a latch mechanism is locked is often made by turning the knob with a torque exceeding that normally required to unlatch the door to see whether the latch mechanism will operate (e.g., is unlocked). Thus, normal useage of a latch mechanism generally subjects the internal parts thereof to substantial loads, separate and apart from any intention to do damage thereto.

In addition vandals, whether under the impression that forcing a knob will force the mechanism to operate, or merely having the intent to damage a latch assembly, may force door knobs into rotation, resulting in the bending or breakage of internal parts in the latch mechanism. Such occurrences are particularly costly as they occur in assembled and installed mechanisms, requiring the removal thereof for replacement on a temporary or permanent basis and/or the repair thereof on an individual basis. These abuses of latch mechanisms, whether intentional or merely minor in every day use, could be substantially eliminated, however, if the exterior door knob on the latch assembly could be made to freely rotate whenever the latch were locked.

In the prior art, typically the exterior latch operating device, whether a knob or a thumb actuator, is directly coupled to the latch mechanism. Accordingly in normal operation the knob or thumb actuator directly actuates the actuator mechanism to withdraw the latch bolt from the striker plate, thereby allowing the door to open. However, when the lock is in the locked condition, the latch bolt mechanism is prevented from operating, thereby directly restricting the movement of the knob or thumb actuator, and creating the opportunity for abuse of the mechanism whether intentional or inadvertent.

One prior art mechanism is known for decoupling the thumb actuator from the latch bolt mechanism when the mechanism is locked. Such a mechanism is disclosed in U.S. Pat. No. 3,933,016 entitled "DOOR LOCK MECHANISM" issued Jan. 13, 1976 and assigned to the same assignee as the present invention and application.

BRIEF SUMMARY OF THE INVENTION

A lock mechanism with disengageable knob whereby the locking of the mechanism decouples the exterior knob from the latch mechanism to allow the free rotation thereof without damage or detriment to the mechanism. The exterior knob is coupled to a cam member which actuates a spring loaded slide plate, which in turn may pick up a lock mechanism actuating member dependent upon whether the interior lock actuator is in the locked or unlocked position. In normal operation a member is preloaded to engage a slot in the slide plate so that the mechanism is operable by the exterior knob.

A second cam member coaxial with the interior knob is driven by a manually operable locking knob on the interior knob. This second cam member operates against a shifting lever to disengage the spring loaded member from the slide plate thereby disengaging the outer knob and allowing the free reciprocation of the slide plate and free rotation of the exterior knob.

BRIEF DESCRIPTION OF THE DRAWINGS

FIG. 4 is a view, partially cut away, looking into the back of the exterior escutcheon illustrating the operation of the mechanism when in the unlocked condition.

FIG. 5 is a view, partially cut away, looking into a portion of the back of the outer escutcheon illustrating the mechanism in the locked position.

FIG. 6 is a view, partially cut away, looking into the back of the escutcheon illustrating the operation of the mechanism when in the locked condition.

FIG. 7 is a partial cross section taken along line 7—7 of FIG. 5.

DETAILED DESCRIPTION OF THE INVENTION

Figure 1:
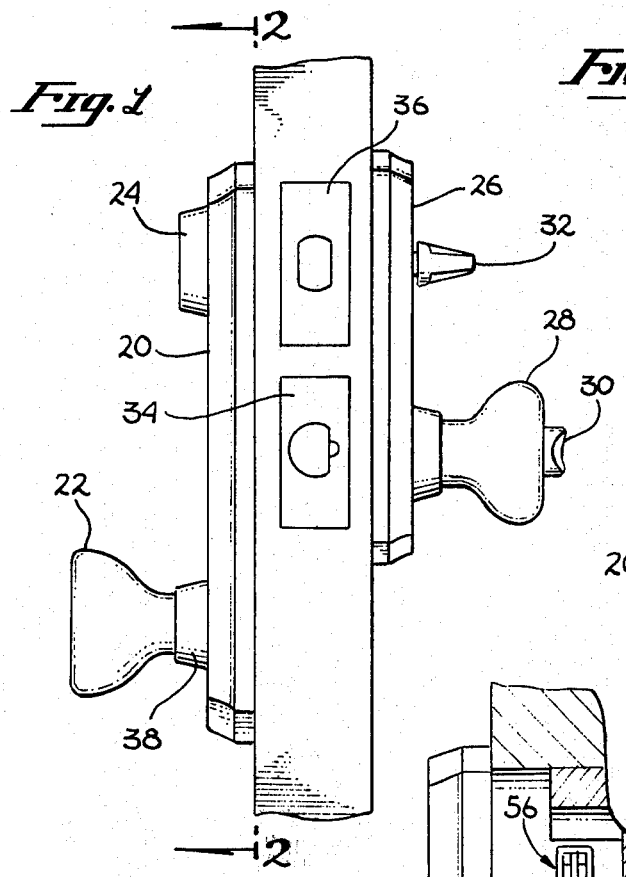
FIG. 1 is an edge view of a portion of a door with the present invention mounted thereon.

First referring to FIG. 1, an edge view of a door with the present invention lock mechanism thereon may be seen. This particular embodiment is characterized by an outer escutcheon 20 supporting a knob 22 and housing a key lock assembly generally indicated by the numeral 24, and an interior escutcheon 26 supporting the inner knob 28 with coaxial lock knob 30 and a manual dead bolt actuator 32. This particular mechanism utilizes a standard latch bolt assembly 34 and a standard dead bolt assembly 36 (though the mechanism driving the dead bolt assembly may vary from the prior art, if desired, in a manner which shall be subsequently mentioned in somewhat greater detail).

Figure 2:
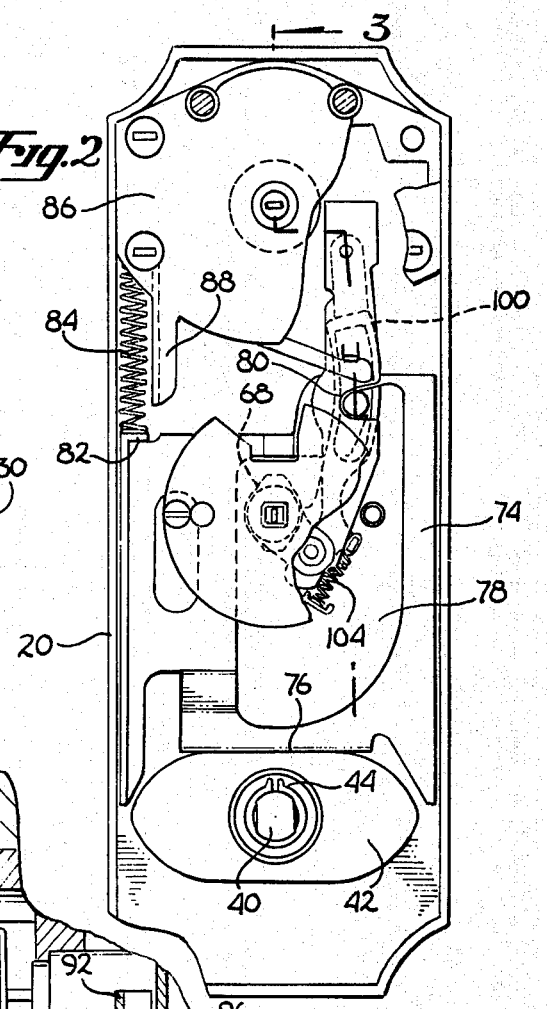
FIG. 2 is a view, partially cut away, looking into the back of the exterior escutcheon.

Now referring to FIG. 2, a view looking into the back of the exterior escutcheon 20, taken along line 2—2 of FIG. 1, may be seen. The exterior knob 22 (FIG. 1) is supported on an outward projecting escutcheon journal 38 and drives shaft 40 in rotation. Keyed to shaft 40 as a result of the non-circular shaft is a cam 42, which in the preferred embodiment is a two-lobed cam, retaining the knob and shaft 40 in cooperative disposition with respect to the cam and escutcheon by a snap ring 44.

Figure 3:
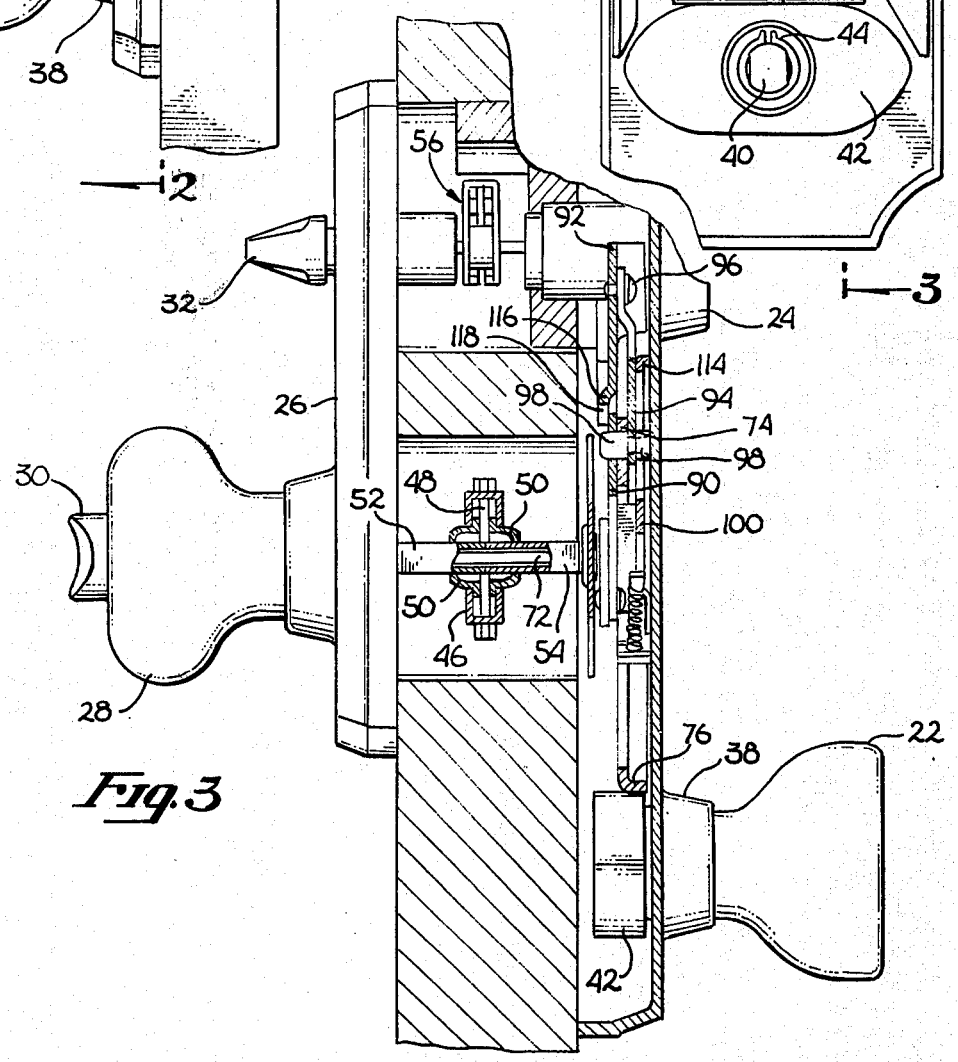
FIG. 3 is a cross section taken along the broken line 3—3 of FIG. 2.

Now referring momentarily to both FIGS. 2 and 3, other major assemblies of the mechanism may be seen. In particular, FIG. 3 is a cross section taken along the broken line 3—3 of FIG. 2, also showing the door and certain aspects of the interior escutcheon and the latch bolt and dead bolt actuating mechanism. In particular, the present invention utilizes a standard latch bolt assembly as shown in FIG. 1, characterized by a housing 46 supporting a slide assembly 48, with rotary drive members 50 being coupled to the slide assembly 48 so as to drive the slide assembly in translation upon the rotation of either of the rotary drive members (rotary drive members 50 may be two individual members as shown in FIG. 3, or a single member, and in that regard, the phrase "rotary drive member" or its equivalent as used herein and in the appended claims is used in the general sense to include one or more such members).

The rotary drive members 50 are driven in rotation by the substantially square, hollow shafts 52 and 54, with shaft 52 being coupled to the interior knob 28 and shaft 54, as shall subsequently be seen, being driven in rotation by the exterior knob 22 whenever the lock mechanism is unlocked. Also visible in FIG. 3 is the dead bolt mechanism 56 forming a part of the dead bolt assembly 36, driven interiorly by the latch bolt actuator 32 and exteriorly by the lock assembly 24.

Now referring to FIG. 7, a cross section taken along line 7—7 of FIG. 5 may be seen. This cross section illustrates the structure in the outer escutcheon 20 in the region of the drive for the latch bolt assembly 34. In particular, one of members 50 is driven by the square hollow shaft 54 which extends through a hold-down plate 58, fastened by screws 60 to elevated bosses 62 on the interior of the exterior escutcheon. The square shaft 54 is retained in the position shown by a snap ring 64 in a cooperatively disposed snap ring groove in the shaft, with the square shaft extending slightly therebeyond to provide a positive rotational drive for lever member 66. The innermost end of shaft 54 has the corners thereof rounded to provide a slight bearing surface for a double lobed cam 68, supported for rotation at the opposite side thereof by an appropriate cylindrical projection 70 on the escutcheon wall. As is shown in FIGS. 1 and 3, the interior knob 28 has a centrally disposed locking knob 30 carried thereon, which in general is of conventional construction for such knobs. This locking knob 30 provides a drive for a smaller square shaft 72 projecting through the square shafts 52 and 54 to provide a positive angular drive for the cam 68.

Now referring again to FIG. 2, further details may be seen. Fitting within the exterior escutcheon 20 is a slide plate 74 which includes a cam follower surface 76, best seen in FIG. 3, for following the cam surface of cam 42 in accordance with the rotation of the exterior knob 22. The slide plate 74 extends upward around cam 68, having clearance therefore as a result of the relatively large opening 78 therein. The opening 78 includes a notch-like area 80 at the upper right portion thereof, which perhaps may be better seen by the marking in phantom in FIG. 6. The slide plate also has an outward projecting tab 82 at the upper left portion thereof to intercept a coil spring 84, yieldably encouraging the slide plate to the lower position as shown in FIGS. 2, 3 and 5. The coil spring 84 in turn is supported at the upper end thereof by a plate 86 enclosing the dead bolt lock drive mechanism, with a downward projecting finger 88 retaining the coil spring against side motion. The finger 88 is at a different elevation than the portion of the slide plate 74 immediately therebelow so as to not interfere with the upward motion thereof upon rotation of the exterior knob 22.

The lever 66 (best seen in FIG. 6) is coupled to a connecting member or lever actuator member 90. The sides of the upper end 92 of member 90 are bent over to provide a slide against the wall of the escutcheon and under the member 86 containing the various parts of the dead bolt lock assembly, as may be seen in FIG. 3. Member 90 also has riveted thereto a second member 94, with the rivet 96 allowing relative rotation therebetween. The member 94 includes a pin 98 effectively riveted thereto so as to project beyond each side thereof, in particular in one direction projecting high enough so as to be engageable with the notch 80, and in the other direction projecting downward so as to act as a slide pin in a shifting member 100 (see FIGS. 5 and 6). The shifting member 100 is supported adjacent the surface of the escutcheon on a pin 102, partially visible in FIG. 5, with a coil spring 104 extending between a coil spring support member 106 integrally formed as part of the escutcheon and a finger 108 on the shifting member, encouraging the shifting member and thus the lever 94 with the pin 98 thereon into the position shown with respect to FIG. 2. In this position, when the exterior knob is rotated as illustrated in FIG. 4, the cam 42 forces the slide plate 74 upward against coil spring 84. The slide in turn carries pin 98 on member 94 with it, thereby pulling upward on the lever 66 to cause it to rotate through an angle of approximately 90°,thereby rotating shaft 54 (FIG. 3) and withdrawing the latch bolt. It will be noted that in this condition, the cam 68 is generally vertically oriented. However when knob 30 (FIG. 3) is rotated to the locked position, the inner shaft 72 rotates cam 68 to the position shown in FIG. 5. The shifting member 100 has a cam follower surface 112 which is engaged by cam 68 to encourage member 100 to rotate against the force of coil spring 104 to withdraw pin 98 from the notch in member 90, and more importantly from the notch 80 in the slide plate so as to allow the slide plate to freely move upward as shown in FIG. 6 without coupling any motion to the lever 66. Thus the exterior knob is free to rotate, resulting in simple reciprocation of the slide plate 74 without actuation of any further parts of the mechanism.

Having now described the basic organization and operation of the mechanism of the present invention, certain additional constructional details and features of the mechanism will now be described. In particular, most of the parts of the mechanism such as slide plate 74, shifting member 100, member 94, etc. are stamped sheet metal members. Accordingly, unless the slide region in member 100 is elevated somewhat from the surface of the escutcheon, the engagement of pin 98 therewith may be, or eventually become, unreliable. Accordingly, as best seen in FIG. 3, the outer end 114 of member 100 is bent downward toward the escutcheon to space the slide region of the member slightly away from the escutcheon to allow penetration of pin 98 all the way therethrough without being forced against the surface of the escutcheon. Also, as may be seen in FIGS. 3 and 6, member 90 is stamped so as to have a small finger 116 protruding outward so as to be engageable by a lever 118 which, in the preferred embodiment, is actuated by the dead bolt latch mechanism so as to raise member 90 and thus rotate lever 66 to withdraw the latch bolt upon the withdrawal of the dead bolt. While the specific mechanism for accomplishing this action forms no part of the present invention, it is important to generally note that the mechanism for withdrawing the dead bolt may be coupled to the mechanism for withdrawing the latch bolt without interfering with the objects and purposes of the present invention.

There has been described herein one embodiment of a lock mechanism wherein the exterior knob is disengaged from the lock mechanism upon the locking of the door latch by the manual lock coupled to the interior escutcheon. In particular, the mechanism as disclosed and described in detail herein utilizes a slide plate within the outer escutcheon drive with a reciprocating motion by a cam coupled to the exterior knob. The manual locking mechanism, controllable in the preferred embodiment by a locking knob coaxial with the interior knob, controls the coupling of the slide plate motion to the latch actuating mechanism, thereby controllably coupling and decoupling the slide plate motion to the latch. While the preferred form of the present invention is disclosed and described in detail herein, it will be immediately obvious to those of reasonable skill in the art that various changes in form and detail may be made therein without departing from the spirit and scope of the invention.

I claim:

1. A lock mechanism with disengageable knob comprising:

a. an exterior escutcheon;

b. an exterior knob carried by said exterior escutcheon;

c. slide means within said exterior escutcheon for sliding between first and second positions with respect thereto;

d. cam means within said exterior escutcheon, said cam means being coupled to said exterior knob and driven in rotation thereby, said cam means being a means for encouraging said slide means from said first position to said second position upon rotation of said exterior knob;

e. a reciprocating latch bolt;

f. latch bolt drive means for withdrawing said latch bolt, said drive means including a manual latch bolt actuator supported by an interior escutcheon, and;

g. manually operable lock means coupled to said interior escutcheon, said lock means being a means for coupling and decoupling the motion of said slide means to said latch bolt drive means.

2. The lock mechanism of claim 1 further comprised of spring means for encouraging said slide means to said first position.

3. The lock mechanism of claim 1 wherein said manual latch bolt actuator comprises an interior knob, said latch bolt including means for withdrawing said latch bolt upon rotation of a drive member coupled to said interior knob.

4. The lock mechanism of claim 3 wherein said manually operable lock means includes lever means rotationally coupled to said drive member, and a lever actuator means coupled to said lever means, said manually operable lock means further including manually operable means for coupling and decoupling motion of said slide means to said drive member.

5. The lock mechanism of claim 4 wherein said manually operable means for coupling motion of said slide means to said drive member comprises a pin for engaging said slide means and said lever actuator means.

6. The lock mechanism of claim 5 wherein said manually operable lock means comprises a thumb actuator supported by and coaxial with said interior knob.

7. The lock mechanism of claim 6 wherein said manually operable lock means is further comprised of spring loaded locking lever encouraging said pin into engagement with said slide means and said lever actuator means.

8. The lock mechanism of claim 7 wherein said manually operable lock means is further comprised of second cam means coupled to said thumb actuator, said second cam means being a means for encouraging said locking lever to a locked position wherein said pin does not engage at least one of said slide means and said lever actuator means.

9. A lock mechanism with disengageable knob comprising:

a. An exterior escutcheon;

b. an exterior knob carried by said exterior escutcheon;

c. a slide within said exterior escutcheon for sliding between first and second positions with respect thereto;

d. a cam within said exterior escutcheon and coupled to said exterior knob so as to be driven in rotation thereby, said slide having a cam follower surface for engaging said cam whereby said slide may be encouraged between first and second positions upon rotation of said exterior knob;

e. a latch bolt assembly having a reciprocating latch bolt and a rotary latch bolt drive member therefor;

f. an interior escutcheon;

g. an interior knob carried by said interior escutcheon, and coupled to said rotary latch bolt drive member;

h. a lever coupled to said latch bolt drive member;

i. a coupling member coupled to said lever;

j. manually operable lock means coupled to said interior escutcheon, said lock means including means for coupling and decoupling the motion of said slide and said coupling member.

10. The lock mechanism of claim 9 wherein said means for coupling and decoupling the motion of said slide and said coupling member comprises engaging means controlled by said manually operable lock means to engage and disengage said slide plate and said coupling member.

11. The lock mechanism of claim 10 further comprised of a shifting lever means controlled by said manually operable lock means and operative to shift said engaging means between positions of engagement and disengagement between said slide plate and said coupling member.

12. The lock mechanism of claim 11 wherein said manually operable lock means comprises a rotary lock means coupled to a cam means for controlling the position of said shifting lever means by engagement between said last named cam means and a cam follower surface on said shifting lever means.

13. The lock mechanism of claim 10 wherein said engaging means is coupled to said coupling member.

14. The lock mechanism of claim 9 wherein said slide plate is disposed above said cam and has a downward facing cam follower surface for engaging said cam so as to be encouraged thereby between first and second vertical positions.

15. The lock mechanism of claim 14 further comprised of a spring means for yieldably encouraging said slide to the lower position.

16. The lock mechanism of claim 9 wherein said cam is a double lobed cam.

* * * * *